US005199584A

United States Patent [19]

Fowler et al.

[11] Patent Number: 5,199,584

[45] Date of Patent: Apr. 6, 1993

[54] UNIVERSAL FLOOR/SHELF ORGANIZER FOR PRODUCT MERCHANDISING DISPLAY UNITS

[75] Inventors: Dewalt W. Fowler, Manchester; Robert J. Swain, Creve Coeur, both of Mo.

[73] Assignee: Paul Flum Ideas, Inc., St. Louis, Mo.

[21] Appl. No.: 824,296

[22] Filed: Jan. 23, 1992

[51] Int. Cl.[5] ..... A47F 5/00

[52] U.S. Cl. ..... 211/184; 211/59.2

[58] Field of Search ..... 211/184, 49.1, 59.2, 211/59.4; 248/223.4, 224.4

[56] References Cited

U.S. PATENT DOCUMENTS

| | | | |
|---|---|---|---|
| 4,454,949 | 6/1984 | Flum | 211/59.2 |
| 4,474,297 | 10/1984 | Zucker | 211/59.2 |
| 4,478,337 | 10/1984 | Flum | 211/59.2 |
| 4,801,025 | 1/1989 | Flum et al. | 211/59.2 X |
| 4,958,739 | 9/1990 | Spamer | 211/59.2 X |
| 4,971,207 | 11/1990 | Baucom | 211/49.1 |
| 5,020,293 | 6/1991 | Itagaki | 248/223.4 X |

*Primary Examiner*—Ramon O. Ramirez

*Attorney, Agent, or Firm*—Haverstock, Garrett & Roberts

[57] ABSTRACT

A variable shelf organizer for merchandising products therefrom capable of being assembled to accommodate any shelf width and any product dimension including a substantially flat product supporting floor member having a plurality of channel-like spaces associated therewith for cooperatively receiving any one of a plurality of divider members, each divider member being selectively engageable with the channel-like spaces to form any number of segregated product guide channels for arranging products therebetween, the width of each such product guide channel being selectively adjustable by engaging the respective divider members forming the same with different pairs of the channel-like spaces thereby varying the distance between any two adjacent divider members. The product supporting floor member further includes a joinder mechanism enabling a plurality of similarly constructed floor members to be cooperatively engaged in side-by-side relationship with one another so as to form an assembled organizer unit capable of accommodating any particular shelf width

19 Claims, 3 Drawing Sheets

UNIVERSAL FLOOR/SHELF ORGANIZER FOR PRODUCT MERCHANDISING DISPLAY UNITS

The present invention relates generally to shelf organizers for use in a wide variety of product merchandising display units including refrigerated display coolers commonly employed by supermarkets, convenience stores, and other wholesale and retail outlets and, more particularly, to various embodiments of a universal floor/shelf organizer which is capable of being assembled so as to accommodate any shelf width and includes divider members which are adjustably positionable so as to produce product guide channels of varying width to accommodate products of varying sizes and shape. The present shelf organizers can be conveniently supported in a flat horizontal position or in an inclined position for gravity feeding products positioned thereon and represent a one-inventory solution to a particular user's specific needs and applications.

BACKGROUND OF THE INVENTION

One of the problems typically associated with storing and displaying shelved products for sale to customers in a retail store setting is the inefficient use of available shelf space and the inability of the merchant to constantly provide an attractive arrangement of shelved products which are readily visible and easily accessible to the customer. Typically, articles of merchandise, especially products such as numerous bottled and canned soft drink products which are packaged in a wide variety of container sizes and shapes, are randomly distributed and stacked in segregated areas on a shelf or other display device in such a manner that the selection of a particular item, access to that particular item, and the removability of that item from the shelf or display device by the customer becomes, at times, difficult if not impossible. In the present day marketing of consumer products, it is important to maintain the display of products in a suitable and organized fashion.

As a result, a wide variety of display devices and shelf organizers have been designed and manufactured for use in merchandising shelved products to consumers, and such devices are commonly utilized by supermarkets, convenience stores, grocery outlets, fast food outlets, and a wide variety of other wholesale and retail stores to show and focus attention on the particular products displayed therein. Although various shelf organizer constructions are known and have been utilized to alleviate some of the aforementioned problems associated with merchandising shelved products to customers, the known devices generally have limitations in their ability to be compatible with shelves of varying width and, more importantly, they likewise have limitations in their ability to adjust the segregated product channels associated therewith to accommodate products of varying shapes and sizes so that a wider variety of different products may be merchandised from the same units.

SUMMARY OF THE INVENTION

The present invention overcomes many of the disadvantages and shortcomings associated with the known shelf organizer constructions and teaches the construction and operation of a universal type assembly which can be used in conjunction with any known shelf member, which assembly is specifically designed to accommodate varying shelf sizes as well as varying product dimensions. The present shelf organizer includes a plurality of similarly constructed, interlocking units which can be assembled in side-by-side relationship to accommodate any particular shelf width. When assembled to a desired width, the individual units form a smooth, flat and stable floor member upon which a wide variety of shelved products can be easily positioned thereon. Also, importantly, when assembled, the resulting shelf organizer includes a plurality of spaced channels extending the full length thereof from front to rear, each such channel being adaptable for cooperatively receiving and engaging a divider member which can be easily, slidably positioned therewithin. This enables a user to segregate the assembled floor structure into a plurality of parallel guide channels for supporting and guiding products positioned therebetween, each guide channnel being defined by a respective pair of divider members that extend the full length of the floor member between the front and rear portions thereof. Importantly, the respective divider members can be positioned and arranged on the resulting floor structure so as to accommodate products of varying sizes and shapes. This is particularly important because it enables a merchant to cross-merchandise different types of products in a side-by-side relationship on the same shelf.

In addition, the present shelf organizer may likewise include a plurality of spaced longitudinally extending ribs or runners extending upwardly from the floor structure, the runners greatly improving the slidably of the products positioned thereon and moved therealong. This is particularly true when the present shelf organizers are utilized in a gravity feed type system. Several embodiments of the present shelf organizer are disclosed herein, some embodiments incorporating use of the upstanding ribs or runners as an intregal part of the upper surface of each individual interlocking floor member or element, and some embodiments providing means for optionally adding such upstanding ribs or runners to the assembled structure, if desired. Also, some embodiments disclose different means for interlocking the individual floor members with each other. All of the features and capabilities afforded by the present shelf organizers are particularly important to merchants because they provide simple and efficient means for effectively utilizing already existing shelf space; they provide for the orderly and attractive arrangement and display of products; they provide means for adjusting the overall width of the present devices so as to accommodate varying shelf widths; they maximize the use of available display space on any existing shelf unit; they provide a merchant with a greater range of possibilities for maximizing adjacent positioning of dissimilar products on such units by providing means for easily and conveniently forming product guide channels of varying widths to accommodate products packaged and sold in a wide variety of different sizes and shapes; and they enable a merchant to more easily display, organize and cross-merchandise goods to the general public. The selective adjustability of the present shelf organizers provides greater flexibility and versatility in using and orienting such organizers in any particular merchandising area and it allows a particular user to arrange such units accordingly to meet his/her specific needs and/or application.

Also, importantly, the present shelf organizers are adaptable for use with all known, existing display units including display devices which utilize an open-grid type shelf structure. This is particularly true in many of the known refrigerated display coolers and other types of cold vaults commonly found in supermarkets, convenience stores, grocery and fast food outlets, and a wide variety of other wholesale and retail stores. In this regard, when used in conjunction with an open-grid type shelf member, the present shelf organizers provide a flat and stable floor structure able to hold and accommodate products packaged in containers having unique and unusual shapes including unusual shapes or contours associated with their bottom surfaces thereby eliminating the instability of such products when placed on an open-grid type supporting surface. Use of the present devices are also cost effective because they are adaptable for use on and with existing shelving equipment; they require n additional parts; they can be utilized either on a flat shelf or on an inclined support structure for gravity feeding products therefrom; they obviate the need for utilizing a plurality of different shelf organizers to both accommodate different style product containers and to achieve different product display configurations; and, because of their versatility and ability to achieve a wide variety of different product arrangements dictated by the particular needs of the user, they represent a one-inventory solution to a user enabling such user to organize and configure any particular shelf display to meet his/her specific needs and space requirements.

It is therefore a principal object of the present invention to provide an improved shelf organizer unit which affords maximum flexibility to its user and more efficiently utilizes existing shelf space commonly found in supermarkets and other merchandising centers, including shelf space associated with refrigerated display coolers.

Another object is to provide a shelf organizer unit wherein the overall width thereof is adjustable to accommodate varying shelf widths and the overall width of the respective product guide channels associated therewith are adjustable to accommodate products of varying sizes and shapes.

Another object is to provide a shelf organizer unit that is structurally and operationally relatively simple and inexpensive to make and install.

Another object is to provide a shelf organizer unit which is universally adaptable for use with a wide variety of known product merchandising display equipment including equipment utilizing an open-grid type shelf structure.

Another object is to provide a shelf organizer unit which, when positioned on an inclined supporting structure, provides a gravity feed system whereby a supply of the shelved products is always maintained at the front of the unit.

Another object is to provide a shelf organizer unit which attractively organizes the products positioned therein in convenient parallel rows for easy access and removal.

Another object is to provide a shelf organizer unit which affords a user several different options when determining how best to display and arrange the sale of a wide variety of products therefrom.

Another object is to provide a shelf organizer unit adaptable for use both on and with existing shelving equipment, either on a flat shelf or on an inclined support structure for gravity feeding products therefrom.

Another object is to provide a shelf organizer unit which maximizes adjacent positioning of products on such unit.

Another object is to provide a shelf organizer unit which affords a user the opportunity to cross-merchanise a wide variety of goods therefrom.

These and other objects and advantages of the present invention will become apparent to those skilled in the art after considering the following detailed specification which discloses several representative embodiments of the present shelf organizer in conjunction with the accompanying drawings wherein:

DETAILED DESCRIPTION OF THE INVENTION

Figure 1:
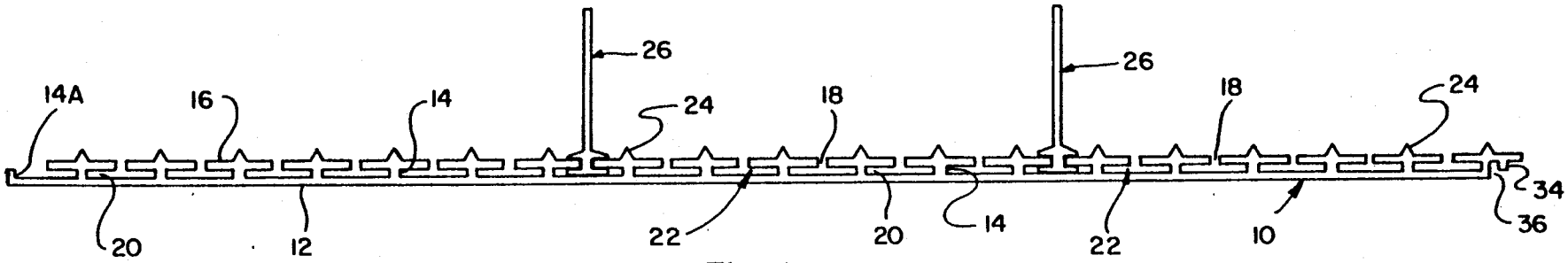
FIG. 1 is a front elevational view of one embodiment of the present shelf organizer unit constructed and assembled according to the teachings of the present invention.
Figure 4:
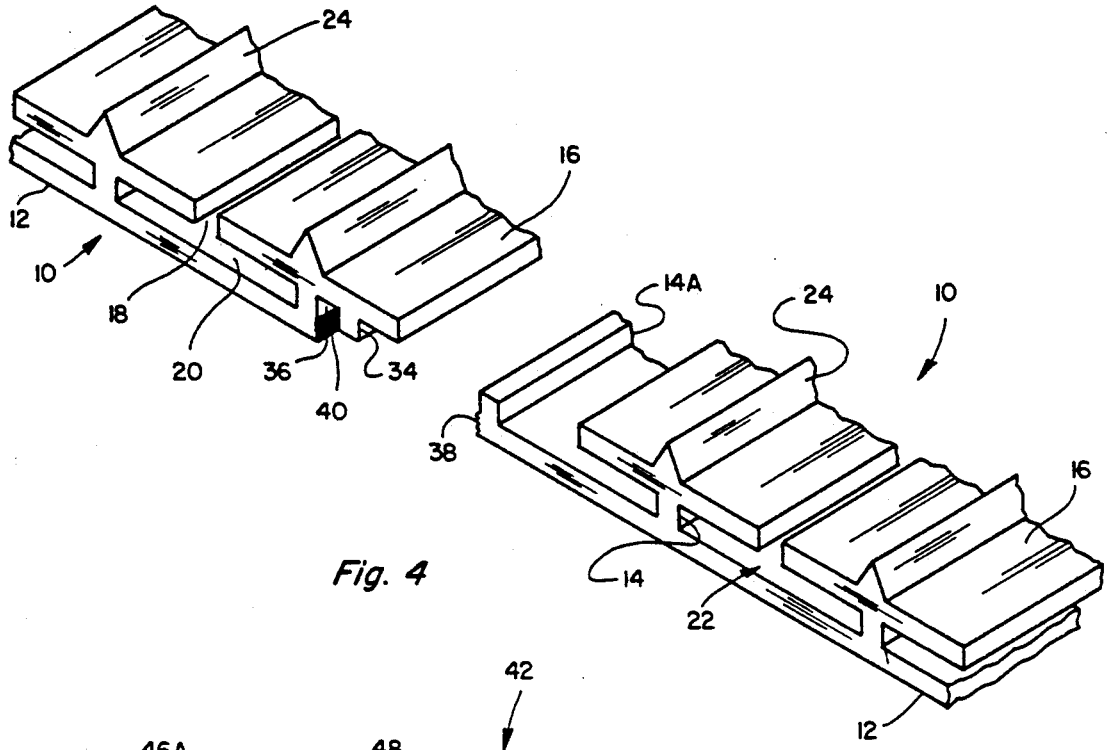
FIG. 4 is an enlarged fragmentary perspective view of two of the present shelf organizer floor elements arranged in side-by-side relationship to each other preparatory to joinder with each other to achieve a particular shelf width.

Referring to the drawings more particularly by reference numbers, wherein like numerals refer to like parts, the number 10 in FIG. 1 identifies a shelf organizer floor member constructed according the teachings of the present invention. The floor member or element 10 is of a sandwich-like construction as best shown in FIGS. 1 and 4 and includes a substantially flat bottom wall member 12, a plurality of longitudinally upwardly extending rib or support members 14, and a plurality of members 16 spaced above the member 12 and extending longitudinally between the front and rear edges thereof, each member 16 being integrally formed with a corresponding upright support member 14 and each being horizontally arranged as shown in FIGS. 1 and 4 so as to form the supporting surface upon which products can be positioned. The upper floor members 16 are horizontally arranged such that a longitudinal slot or opening 18 is formed between each respective pair, each slot 18 communicating with the space 20 formed by and between any two adjacent upright support members 14 and the lower bottom wall member 12. The openings 18 and 20, in combination, form a channel-like space 22 between each respective pair of upright support members 14 extending the full length of the members 12 and 16.

The upper floor members 16 each include at least one longitudinally extending rib or runner 24 projecting upwardly therefrom as best shown in FIGS. 1 and 4. The upstanding ribs or runners 24 are substantially triangularly shaped in cross-section and, because of the materials and lubricants used in their construction, they reduce the friction between the upper floor surfaces 16 and the products positioned thereon thereby improving the slidability of such products therealong. This is particularly important when the present devices are used in a gravity feed arrangement since products positioned thereon must be able to slide under the force of gravity towards the front portion of the gravity feed unit when the forward most products are removed therefrom. The actual construction of the runners 24 as well as the materials and lubricants used to improve the slidability of products positioned thereon are more fully disclosed and described in U.S. Pat. Nos. 4,801,025; 4,454,949; and 4,416,380, all of which were issued to the present assignee. It is also important that the spacing between the runners 24 be such as to accommodate and support any and all of the various products that are to be positioned thereon regardless of the shape or contour of their bottom walls. Since many articles of merchandise are packaged in containers having unique and unusual shapes, it is usually preferred to have the spacing between the runners 24 substantially uniform and relatively small across the width of the organizer member 10 so as to accommodate and support products having many different bottom wall configurations. The specific spacing selected may be especially important for some products that have contoured bottom wall portions to properly support such products on the runners 24 to reduce the possibility that they will overturn. In this regard, each individual upper floor member 16 may include any plurality of runners 24 depending upon the spacing between each pair of runners 24 so selected.

The entire shelf organizer member 10 including its lower and upper members 12 and 16, its upright support members 14, and the friction reducing runners 24 is preferably of unitary construction and can be extruded or injection molded from a wide variety of plastic and other materials as disclosed in U.S. Pat. Nos. 4,801,025; 4,454,949; and 4,416,380. Although not required, the impregnation of silicon or other lubricants into the plastic materials used to fabricate the floor members 16 and the runners 24 substantially reduces the possibility that products stored thereon will jam or stick and not slide and it greatly enhances the reliability and effectiveness of the present shelf organizers 10 when they are employed in a gravity feed system.

Figure 2:
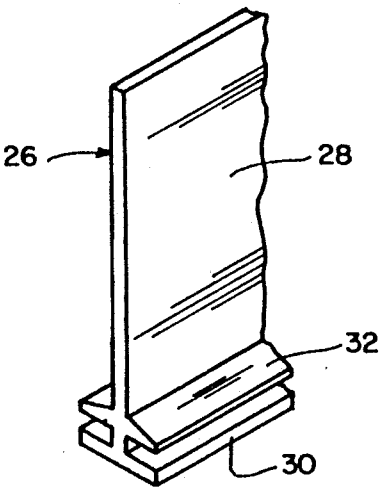
FIG. 2 is a partial perspective view of one of the divider members of FIG. 1.
Figure 3:
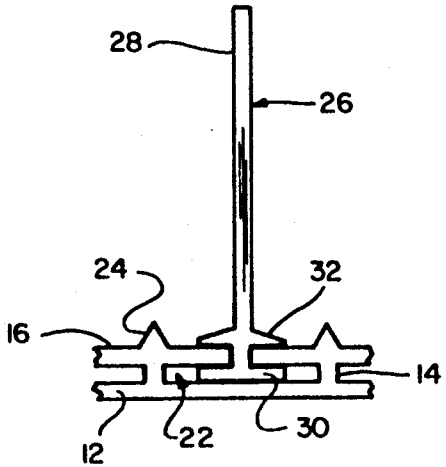
FIG. 3 is an enlarged partial front elevational view of a portion of the shelf organizer of FIG. 1 showing engagement of one of the divider members with one of the longitudinal channels associated with the floor element.

A plurality of upstanding wall partitions or divider members such as the divider members 26 illustrated in FIGS. 1 and 2 may be utilized in conjunction with the shelf organizer member 10 in order to segregate products positioned on the member 10 into parallel rows. As best shown in FIG. 2, each divider member 26 includes an upright wall member 28 having a pair of spaced transverse members 30 and 32 associated with the lower end portion thereof. The transverse member 30 is preferably integrally formed with the wall portion 28 and extends substantially the full length of the member 28 along its lower edge surface as shown in FIGS. 1-3. The width of the member 30 is specifically dimensioned so as to be slidably receivable within the space 20 formed by and between each respective pair of support members 14, the member 30 frictionally engaging the respective upper and lower surfaces of the members 12 and 16 as shown in FIGS. 1 and 3. The transverse member 32 is positioned and located in spaced apart relationship above the member 30 such that when the divider member 26 is engaged with the channel-like opening 22, the lower surface of the member 32 will rest upon and frictionally engage the upper surface of the respective adjacent members 16 as best shown in FIG. 3. In this regard, the spacing between the members 30 and 32 should be such as to allow the divider member 26 to be easily moved along the full length of each respective channel-like opening 22 while at the same time providing sufficient frictional engagement with the members 12 and 16 such that the divider members 26 will be firmly held in engagement with the member 10 and will not move or otherwise be dislodged therefrom during use when properly positioned and located within any one of the channel-like openings 22. Like the member 30, the transverse member 32 likewise extends substantially the full length of the member 28 on both opposite sides thereof as shown in FIG. 2 and is preferably integrally formed therewith. Also, importantly, the width of the wall portion 28, at least between the members 30 and 32, is likewise specifically dimensioned so as to be slidably receivable within the space 18 formed by and between each respective pair of members 16 when the member 30 is engaged with the space 20 as best shown in FIGS. 1 and 3.

Because of the present construction, it is important to note that the divider members 26 may be selectively positioned within any plurality of the channel-like openings 22 in the member 10 depending upon the size, shape and overall dimensions of the particular products positioned thereon, each respective pair of divider members 26 defining therebetween a product guide channel for supporting and guiding products positioned therebetween in parallel rows. This enables a merchant to easily segregate any or all of the shelf organizer members 10 into a plurality of parallel guide channels for supporting and guiding products positioned therebetween, each guide channel being selectively adjustable to accommodate any product width. This substantially increases the flexibility and use of such devices and provides the merchant with a greater range of possibilities for both maximizing shelf space and for cross-merchandising a wide variety of products therefrom.

Figure 5:
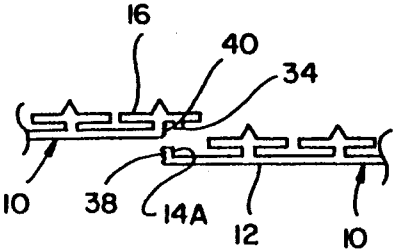
FIG. 5 is a partial, exploded front elevational view of two of the present shelf organizer floor elements positioned for engagement with each other.

Since the width of the shelves or other shelf areas upon which the present shelf organizer member 10 is to be employed may vary depending upon the particular type and style of product merchandising display unit being utilized, the shelf organizer member 10 is specifically designed such that a plurality of such members can be assembled in side-by-side interlocking relationship with each other to accommodate any particular shelf width. This is accomplished by providing cooperatively engagable means on the respective opposite side portions of the members 10 such that one side portion of one member 10 will interlock and engage with the opposite side portion of another similarly constructed member 10 positioned adjacent thereto. More particularly, such cooperatively engageable means includes one side end portion of the member 10 terminating with a support member 14A extending upwardly from the lower member 12, while the opposite side end portion of the member 10 terminates with a support member 34 extending downwardly from the most endwardly located upper floor member 16 associated with such side end portion as best shown in FIGS. 1, 4 and 5. The downwardly extending support member 34 is positioned and located inwardly from the terminal end of the affected upper floor member 16 so as to define a channel-like space 36 between such member 34 and the adjacent support member 14 (FIGS. 1, 4 and 5). The size and shape of the space 36 is dictated by the size and shape of the terminal support member 14A such that, when positioned in side-by-side relationship as best illustrated in FIGS. 4 and 5, the terminal support member 14A will snap into and frictionally engage the space 36. This is made possible by having the member 12 extend beyond the most endwardly located upper floor member 16 on the side of the member 10 where the terminal support member 14A is located and by having the most endwardly located upper floor member 16 extend beyond the lower member 12 on the opposite side thereof where the support member 34 and space 36 are located.

Figure 6:
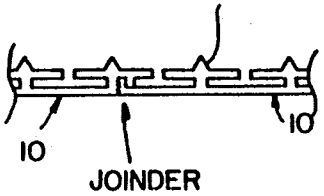
FIG. 6 is a partial front elevational view showing the two shelf organizer floor elements of FIGS. 4 and 5 joined together.

When two members 10 are interlocked with each other as illustrated in FIG. 6, the terminal end portion of the support member 14A rests upon the bottom wall surface of the upper floor member 16 located thereabove and the terminal end portion of the support member 34 rests upon the upper wall surface of the member 12 positioned therebelow. This joinder arrangement continues the sandwich-like structure of the members 10 when a plurality of such members are joined together in side-by-side relationship. Such construction and joinder arrangement likewise provides additional strength, rigidity and stability at the point of joinder such that products may be positioned and arranged directly thereabove without fear of weakening or otherwise causing damage to the present floor structure at the point of joinder. In essence, the members 14A and 34 form a double-wall support member at the point of joinder sufficient to accommodate the weight of the particular products positioned thereon. In this regard, the size, spacing and strength of the various members comprising the shelf organizer member 10 including the members 14A and 34 and the space 36 may be varied depending upon the particular use and application of the present devices as well as the particular types of products to be positioned thereon. Optional means in the form of a serrated edge associated with the outwardly facing surface of the terminal support members 14 and 14A associated with each respective side portion of the member 10 such as the serrated edge portions 38 and 40 as best shown in FIGS. 4 and 5 may be utilized to improve the joinder between two respective members 10. Use of the serrated edge portions 38 and 40 or any other similar means helps to prevent disengagement of the respective members 10 during use.

As can be seen from a review of FIGS. 4, 5 and 6, any plurality of the shelf organizer members 10 can be assembled in side-by-side interlocking relationship so as to accommodate any particular shelf width. In this regard, the overall length of the organizer members 10 can be varied to accommodate different shelf depths without departing from the teachings and practice of the present invention including fabricating a plurality of such members 10 having different or varying widths associated respectively therewith such that various combinations of the floor members 10 can be combined and assembled to accommodate any particular shelf width.

Figure 7:
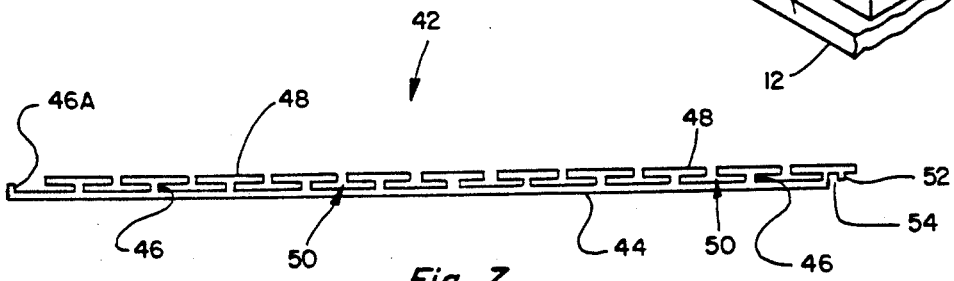
FIG. 7 is a front elevational view of another embodiment of the present shelf organizer floor element.
Figure 9:
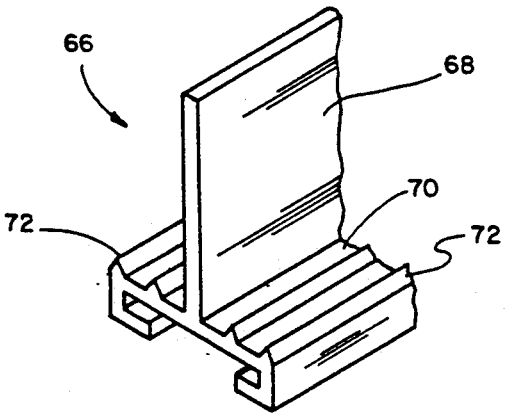
FIG. 9 is a partial perspective view of another embodiment of a divider member which may be utilized with the shelf organizer floor element of FIG. 7.
Figure 8:
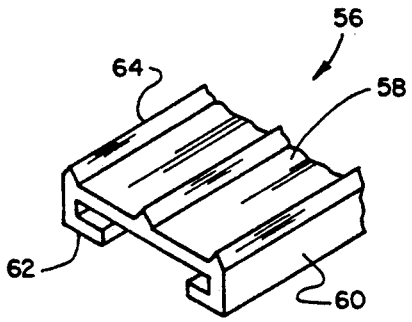
FIG. 8 is a partial perspective view of a track element that may be utilized with the shelf organizer floor element of FIG. 7.

FIGS. 7-9 illustrate various components of another embodiment of the present shelf organizer unit constructed according to the teachings of the present invention. More specifically, FIG. 7 illustrates another embodiment 42 of the floor member 10, the floor member 42 having a substantially flat bottom wall member 44, a plurality of upright support members 46, and a plurality of spaced apart upper floor members 48 forming the same sandwich-like structure as the member 10. The floor member 42 is substantially similar in construction and operation to the floor member 10 disclosed in FIGS. 1, 4 and 5 except that the member 42 does not include a plurality of upstanding ribs or runners associated with its upper floor members 48 such as the ribs 24 associated with the members 16. Instead, the plurality of upper floor members 48 form a substantially smooth and flat floor surface for positioning products thereon. In all other respects, the floor member 42 is substantially identical to the floor member 10 including having a plurality of channel-like spaces 50 formed by and between each respective pair of upright support members 46 extending the full length of the members 44 and 48 similar to the channel-like spaces 22 associated with the member 10 (FIG. 1), and also having cooperatively engageable means associated with the respective opposite side portions thereof in the form of the members 46A and 52 and the space 54 all of which are substantially similar to the members 14A and 34 and the space 36 associated with the member 10. Like the members 14A and 34, the members 46A and 52 are positioned and dimensioned on each respective opposite side portion of the member 42 so as to enable a plurality of such members 42 to be assembled and joined together in side-by-side interlocking relationship with each other so as to accommodate any shelf width in the same manner as previously described with respect to the shelf organizer floor member 10.

Since the sandwich-like structure of the member 42 is identical to that of member 10, the divider members 26 (FIGS. 1 and 2) may also be utilized in conjunction with the shelf organizer member 42 in order to segregate products positioned thereon into parallel rows. Engagement of the divider members 26 with the floor member 42 is identical to that previously described with respect to the engagement of the members 26 with the floor member 10. Use of the floor member 42 affords a particular user the opportunity to assemble a unit having a smooth, flat supporting floor surface for those applications where such a product supporting surface is desired.

Figure 10:
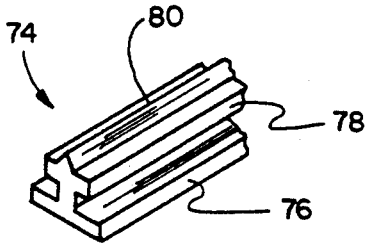
FIG. 10 is an enlarged partial perspective view of another embodiment of the track element of FIG. 8.

FIG. 8 illustrates the construction of a track member 56 specifically adaptable for use with the shelf organizer floor member 42. The track member 56 includes a substantially flat supporting member 58 having a pair of spaced opposed L-shaped parallel leg members 60 and 62 extending from the opposite end portions thereof as shown in FIG. 8. The leg members 60 and 62 are specifically shaped and dimensioned so as to be slidably receivable into any one of the longitudinally extending channel-like spaces 50 associated with the member 42 as best shown in FIG. 10. The supporting member 58 includes a plurality of longitudinally extending ribs or runners 64 projecting upwardly therefrom, the runners 64 being substantially similar in construction and operation to the runners 24 associated with the floor member 10. It is important to note that the supporting member 58 is dimensioned widthwise such that the respective opposite leg members 60 and 62 are positioned and located so as to slidably engage any two of the channel-like spaces 50 associated with the member 42. It is recognized that the overall width of the track member 56 may be varied depending upon its particular use and application without departing from the teachings of the present invention so long as the respective leg members 60 and 62 are dimensioned and positioned so as to slidably engage any two of the channel-like spaces 50 as previously explained. The track members 56 are constructed so as to extend substantially the full length of the floor element 42 and the leg members 60 and 62 should be dimensioned so as to be easily, slidably movable along the full length of each respective channel-like opening 50 while at the same time providing sufficient frictional engagement with such channel-like openings such that the track members 56 will be firmly held in engagement with the member 42 when properly positioned and located therewithin. Use of the track member 56 enables a user to easily add the use of the runners 64 to the organizer floor member 42 so as to improve the slidability of products positioned thereon in those applications where use of the runners 64 is advantageous and desirable such as in a gravity feed-type system. This provides greater flexibility and affords a user several different options when determining how best to display and arrange a wide variety of products on shelf space employing the present units.

FIG. 9 illustrates the construction of another embodiment 66 of a track member which is specifically adaptable for use with the organizer floor member 42. The track member 66 is substantially identical in construction and operation to the track member 56 (FIG. 8) but differs therefrom in that it further includes an upstanding wall member 68 extending upwardly from the supporting member 70 at an intermediate location thereon (FIG. 9), the member 66 further differing from the track member 56 in that it includes a different arrangement of runners 72 as compared to the arrangement of runners 64 utilized with respect to track member 56. In all other respects, the construction of the member 66 is substantially identical to the construction of the track member 56.

Figure 11:
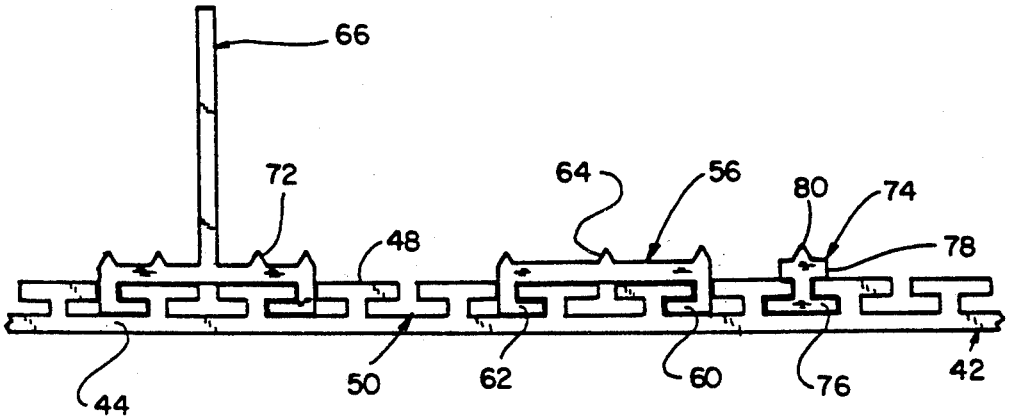
FIG. 11 is a partial front elevational view of the shelf organizer floor element of FIG. 7 showing the track elements and divider member of FIGS. 8, 9 and 10 cooperatively engaged therewith.

The member 66 represents another embodiment of a divider member such as the divider members 26 illustrated in FIGS. 1 and 2 which may be utilized in conjunction with the the track members 56 and 74 as will be hereinafter explained in order to segregate products positioned on the member 42 into parallel rows. Engagement of the member 66 with the shelf organizer 42 is likewise illustrated in FIG. 11. Use of the members 66 not only enables a user to selectively segregate any or all portions of the member 42 into a plurality of parallel guide channels for supporting and guiding products positioned therebetween, each guide channel being selectively adjustable to accommodate any product width, but use of the members 66 in conjunction with the members 56 and 74 also enable a user to incorporate use of the product runners into the product guide channels so as to improve the slidability of products positioned therewithin.

FIG. 10 illustrates still another embodiment of a track member 74 specifically adaptable for use with the shelf organizer floor member 42. The track member 74 includes a pair of spaced transverse members 76 and 78 constructed and arranged substantially similar to the arrangement of the members 30 and 32 associated with the lower end portion of the divider member 26 illustrated in FIG. 2. Like the transverse members 30 and 32 (FIG. 2), the members 76 and 78 are positioned, located and specifically dimensioned so as to be slidably receivable within and frictionally engageable with any one of the plurality of channel-like spaces 50 associated with the member 42. The transverse member 78 includes a longitudinally extending rib or runner 80 projecting upwardly therefrom, the runner 80 being substantially similar in construction and operation to the runners 24, 64 and 72 associated with the members 10, 56 and 66. Like the members 26, 56 and 66, the track member 74 is constructed so as to extend substantially the full length of the floor element 42 and enables a user to easily add the use of product runners to the floor member 42 where the use of the members 56 and 66 do not provide sufficient coverage. Use of the member 74 in conjunction with the members 56 and/or 66 provide even greater flexibility in selectively assembling a product guide channel having runners associated therewith extending the entire width thereof. Engagement of the member 74 with the shelf organizer 42 is likewise illustrated in FIG. 11.

As can be seen, the shelf organizer floor member 42 is adaptable for use with the members 26, 56, 66 and 74 in any combination thereof and as such, affords a user the most flexibility in determining how best to display and cross-merchandise a wide variety of products therefrom. For example, a plurality of the floor members 42 may be assembled to accommodate any particular shelf width and such members may be utilized in and of themselves to provide a substantially flat, smooth supporting surface for positioning products thereon; the divider members 26 may be utilized in conjunction with the member 42 to segregate the member 42 into a plurality of selectively adjustable product guide channels having a smooth, flat floor surface associated respectively therewith; the track members 56 and 74 may be utilized in conjunction with the organizer member 42 to reduce the friction between the supporting floor surface and the products positioned thereon thereby improving the slidability of such products positioned thereon; and the members 56, 66 and 74 may be utilized in conjunction with the organizer member 42 to segregate the member 42 into a plurality of selectively adjustable product guide channels, each guide channel having a supporting surface comprised of a plurality of longitudinally extending runners 64, 72 and 80 to improve the slidability of products positioned thereon. It is also recognized and anticipated that any or all combinations of the above-identified various variations of use of the present shelf organizer member 42 in combination with the various components 26, 56, 66 and 74 may be utilized on any one shelf or in any particular display application.

Figure 12:
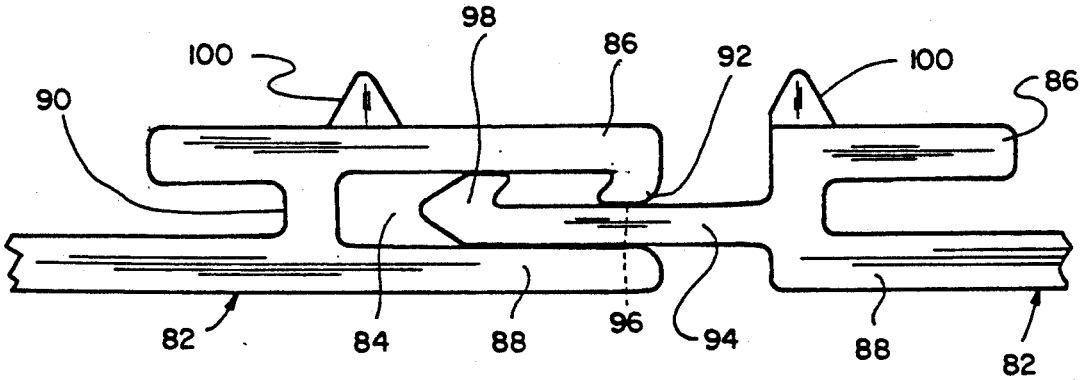
FIG. 12 is an enlarged partial front elevational view of still another embodiment of the present shelf organizer floor elements showing two such floor elements joined together.

FIG. 12 illustrates still another embodiment 82 of the floor member 10, the floor members 82 being substantially similar in construction and operation to the floor member 10 (FIGS. 1 and 4) but differ therefrom in that the members 82 incorporate different cooperatively engagable means for joining such members together in side-by-side interlocking relationship with one another. In this regard, instead of utilizing the joinder arrangement associated with the members 10, namely, the members 14A and 34 and the channel-like space 36, the cooperatively engagable means associated with the floor elements 82 includes one side end portion of the members 82 terminating with a substantially enclosed space 84 defined by the upper and lower members 86 and 88 respectively, the upright support member 90, and the downwardly extending projection member 92, while the opposite side end portion of the members 82 terminate with a sidewardly extending member 94 as illustrated in FIG. 12. The member 94 extends substantially the full length of the floor element 82 and is shaped and dimensioned so as to be slidably receivable within the opening or channel 96 formed by and between the upper surface of the lower wall member 88 and the terminal end portion of the downwardly extending projection member 92. The terminal end portion of the member 94 likewise includes an upwardly extending projection portion 98, the projection portions 92 and 98 being sized and shaped so as to cooperatively engage each other when moved into contact with each other thereby forming stop means for preventing one floor element 82 from becoming disengaged or otherwise disconnected from an adjacent floor element 82. Insertion of the projection portion 98 of the member 94 through the opening or channel 96 and within the space 84 as shown in FIG. 12 is achieved by merely spreading apart the upper and lower members 86 and 88 to allow passage of the projection portion 98 therethrough. The pointed or tapered shape of the leading edge portion of the projection 98 facilitates passage of such portion through the channel 96. Also, importantly, the projecting portion 98 of the member 94 is slidably moveable within the space 84 to some extent thereby further facilitating easy joinder and positioning of adjacent floor members 82. Disengagement of adjacent floor member 82 is accomplished by again spreading apart the upper and lower members 86 and 88 while simultaneously retracting the member 94 and the projection portion 98 through the channel 96.

Although the shelf organizer floor members 82 illustrated in FIG. 12 may likewise include a plurality of longitudinally extending ribs or runners 100 projecting upwardly from the respective upper floor members 86, it is recognized that each member 82 could likewise be constructed without such upstanding ribs or runners. Instead, the plurality of upper floor members 86 could form a substantially smooth and flat floor surface similar to the upper floor surface associated with the floor members 42 (FIG. 7). It is also recognized that since the sandwich-like structure of the members 82 is identical to that of the members 10 and 42, the divider members 26 (FIGS. 1 and 2) may also be utilized in conjunction with the shelf organizer members 82. Also, importantly, if the shelf organizer members 82 do not include the ribs or runners 100, then the members 26, 56, 66 and 74 may likewise be utilized in cooperation with the members 82 in an combination thereof.

It is important to note that the present shelf organizers are adaptable for use with all known, existing display units including display equipment which utilize an open-grid type shelf structure. Such open-grid type shelf structures are commonly utilized in refrigerated display coolers and other types of cold vaults commonly found in supermarkets, convenience stores, and a wide variety of other wholesale and retail stores. When used in conjunction with such open-grid type shelf members, the present shelf organizers provide a stable, flat floor structure capable of holding and accommodating a wide variety of products including products packaged in containers having unique and unusual shapes associated with their bottom wall surfaces. This is particularly important because many products, depending upon the size, shape and configuration of the packaging or containers in which they are sold, are not supported in a stable condition when placed on an open-grid type supporting structure and such products have a tendency to lean to one side, overturn, or otherwise become stuck or trapped between the open-grid type structure during customer manipulation and selection of such products. In this regard, the present shelf organizers are adaptable for use with any type of shelf support structure or framework so long as sufficient framework exist to provide adequate support to the present shelf organizers based upon the weight of the products to be positioned thereon.

It is also recognized that the present shelf organizers can be utilized either on a flat supporting surface or on an inclined support structure for gravity feeding products therefrom. Also, importantly, it is further recognized and anticipated that the present shelf organizers will be utilized for converting a substantially flat shelf display area to a gravity feed orientation by simply assembling and positioning the present shelf organizers on the flat shelf display area and thereafter elevating the rear portion thereof so as to impart the desired inclination to the present shelf organizers for a gravity feed operation. Various means for accomplishing this gravity feed conversion are known and some of such conversion means are disclosed and illustrated in U.S. Pat. No. 4,763,796 issued to the present assignee. Still further, certain known types of shelving systems such as the ARDCO and ANTHONY load carrying rack systems are particularly adaptable for conversion to a gravity feed type operation by simply elevating the rear portion of the shelves associated with such systems to achieve a desired inclination such that when the present shelf organizers are positioned thereon, rows of products positioned on the present organizers will slide under the force of gravity towards the front portion of the unit. Means for accomplishing conversion of the ARDCO and ANTHONY display systems to a gravity feed type operation are disclosed in U.S. Pat. No. 4,478,337 likewise issued to the present assignee. When used in a gravity feed type orientation, it is also recognized that some type of stop means located adjacent the front portion of the present shelf organizers is generally preferred for holding and retaining products positioned thereon until such products are removed therefrom. Such stop means will typically include the front wall associated with the particular display shelf or unit upon which the present shelf organizers are placed. It is also recognized that other suitable stop means may be utilized in this situation either in conjunction with the present shelf organizers or in conjunction with the existing shelf structure upon which the present organizers are positioned.

The various components of the present shelf organizers are preferably constructed from a relatively rigid plastic material able to withstand moderate impact and mishandling without breakage and such components are likewise suitable for fabrication by either a thermoforming process, an injection molding process or an extrusion process. It is also recognized that other various acceptable materials of construction are available and could likewise be employed to construct the various components of the present invention.

The present shelf organizer system therefore provides a user with a single system which is universally adaptable for use with a wide variety of product merchandising display units including units having open-grid type shelf structures associated therewith. In addition, the present shelf organizer units, as explained above, allow for a wide variety of configurations and this ability achieves flexible adaptation to any retail requirement and provides a convenient one-inventory solution to attractively arranging, organizing and cross-merchandising a wide variety of shelved products to consumers. The present organizer units comprise standarized and universal-type components which enable them to be assembled and arranged to achieve any desired product orientation as dictated by the particular needs of the individual users in the field. Use of the present shelf organizers obviates the need for a merchant or other user to stock and use a wide variety of different shelf organizers in order to achieve the different product display configurations discussed above, all of which arrangements are achievable through use of the present organizer system.

Thus, there has been shown and described several embodiments of a univeral floor/shelf organizer unit for use in storing and merchandising shelved products therefrom, which devices fulfill all of the objects and advantages sought therefor. Many changes, modifications, variations, and other uses and applications of the present constructions will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A shelf organizer for merchandising products therefrom comprising a substantially flat product supporting member having front, rear and opposed side portions, said product supporting member having joinder means associated therewith enabling said member to be cooperatively engaged with a similarly constructed product support member, a plurality of divider members for forming optional segregated channels on said product supporting member for arranging products therebetween, said product supporting member further including a plurality of spaced means each adaptable for cooperatively engaging any one of said divider members, said divider members being removably engageable with the spaced means on said product supporting member so as to selectively vary the distance between any two adjacent divider members.

2. The shelf organizer defined in claim 1 wherein said joinder means includes cooperatively engageable means associated with each respective side portion of said product supporting member.

3. The shelf organizer defined in claim 1 wherein said product supporting member includes a plurality of spaced upstanding ribs upon which products are supported for sliding movement therealong.

4. The shelf organizer defined in claim 1 wherein said plurality of spaced means on said product supporting member for cooperatively engaging any one of said divider members includes a plurality of channel-like spaces extending substantially the full length of said member between the front and rear portions thereof, each of said divider members being selectively removably engageable with each of said channel-like spaces.

5. The shelf organizer defined in claim 1 including track means engageable with the spaced means associated with said product supporting member, said track means including at least one upstanding rib upon which products are supported for sliding movement therealong.

6. The shelf organizer defined in claim 5 wherein said track means further includes an upstanding wall portion extending upwardly therefrom, said wall portion segregating products positioned on either side thereof.

7. A variable shelf organizer for merchandising products therefrom adaptable to accommodate varying shelf sizes and varying product dimensions, said shelf organizer comprising a substantially flat product supporting member having front, rear and opposed side portions, said product supporting member having joinder means associated with each respective side portion thereof, said joinder means enabling a plurality of similarly constructed shelf organizers to be cooperatively engaged in side-by-side relationship with one another, the joinder means associated with one of said product supporting members being cooperatively engageable with the joinder means associated with another product supporting member positioned adjacent thereto, a plurality of upstanding wall members each having means associated respectively therewith for cooperatively engaging any one of a plurality of means associated with said product supporting member, said upstanding wall members being selectively removably engageable with said product supporting member so as to form segregated channels of variable width for arranging products therebetween.

8. A shelf organizer adaptable to be supported on a support structure comprising a generally planar floor member having front, rear and opposed side edge portions, a plurality of divider members for forming segregated channels on said floor member for arranging products therebetween, said floor member including a plurality of spaced means each adaptable for cooperatively receiving means associated with each of said divider members for selectively removably engaging any number of said divider members with said floor member, each respective pair of divider members defining a channel for arranging products therebetween, the width of each such product channel being adjustable by engaging said divider members with different combinations of said floor receiving means, said floor member further including joinder means associated with each opposed side portion thereof, the joinder means associated with one side portion of said floor member being cooperatively engageable with the joinder means associated with the opposite side portion of said floor member thereby enabling a plurality of said shelf organizers to be engaged in side-by-side relationship to each other.

9. The shelf organizer defined in claim 8 wherein said floor member includes a plurality of spaced upstanding ribs extending substantially the full length thereof between said front and rear edge portions upon which products are supported for sliding movement therealong.

10. The shelf organizer defined in claim 8 wherein said plurality of spaced floor receiving means includes a plurality of channel-like spaces extending substantially the full length of said floor member between the front and rear edge portions thereof, each of said divider members being selectively removably engageable with each of said channel-like spaces.

11. The shelf organizer defined in claim 8 including track means engageable with the receiving means associated with said floor member, said track means including a plurality of spaced upstanding ribs upon which products are supported for sliding movement therealong.

12. The shelf organizer defined in claim 11 wherein said track means further includes an upstanding wall portion extending upwardly therefrom, said wall portion segregating products positioned on either side thereof.

13. The shelf organizer defined in claim 8 wherein the joinder means associated with one side portion of said floor member includes an upwardly extending flange member, and the joinder means associated with the opposite side portion of said floor member includes a channel-like space extending therealong, said channel-like space being dimensioned to frictionally engage said upwardly extending flange member.

14. The shelf organizer defined in claim 8 wherein the joinder means associated with one side portion of said floor member includes channel-like means, and the joinder means associated with the opposite side portion of said floor member includes a member cooperatively engageable with said channel-like means.

15. A shelf member adaptable to be supported on a support structure comprising a generally planar floor member having front, rear and opposed side portions, a plurality of divider members for forming segregated channels on said floor member for arranging products therebetween, said floor member including a plurality of spaced channel-like spaces each adaptable for slidably receiving any one of said divider members, said divider members being selectively removably engageable with the channel-like spaces of said floor member so as to form any number of segregated channels of variable width for arranging products therebetween, said floor member further including joinder means associated with each opposite side portion thereof, said joinder means enabling a plurality of similarly constructed shelf organizers to be cooperatively engaged in side-by side relationship with one another, the joinder means associated with one side portion of one of said floor members being cooperatively engageable with the joinder means associated with one side portion of another floor member positioned adjacent thereto.

16. The shelf organizer defined in claim 15 wherein said channel-like spaces extend substantially the full length of said floor member between the front and rear portions thereof, each of said divider members being selectively removably engageable with each of said channel-like spaces.

17. The shelf organizer defined in claim 15 wherein said floor member includes a plurality of spaced upstanding ribs extending substantially the full length thereof between said front and rear portions upon which products are supported for sliding movement therealong.

18. The shelf organizer defined in claim 15 including track means engageable with the channel-like spaces associated with said floor member, said track means including at least one upstanding rib upon which products are supported for sliding movement therealong.

19. The shelf organizer defined in claim 18 wherein said track means includes a wall portion extending upwardly therefrom, said wall portion segregating products positioned on either side thereof.

* * * * *

UNITED STATES PATENT AND TRADEMARK OFFICE

CERTIFICATE OF CORRECTION

PATENT NO. : 5,199,584

DATED : April 6, 1993

INVENTOR(S) : Dewalt W. Fowler and Robert J. Swain

It is certified that error appears in the above-indentified patent and that said Letters Patent is hereby corrected as shown below:

In the Abstract, line 20, after "width", insert --.--.

Column 3, line 15, "n" should be --no--.

Column 11, line 55, "an" should be --any--.

Signed and Sealed this

Twenty-third Day of November, 1993

*Attest:*

*Attesting Officer*

BRUCE LEHMAN

*Commissioner of Patents and Trademarks*